US005458548A

United States Patent [19]

Crossing et al.

[11] Patent Number: 5,458,548

[45] Date of Patent: Oct. 17, 1995

[54] FITNESS QUANTIFICATION EXERCISER

[76] Inventors: Ian F. Crossing, 32 Bishop Street, Skye SA 5072, Australia; Brenton K. Payne, 4 Lander Avenue, Sheidow Park SA 5158, Australia

[21] Appl. No.: 158,929

[22] Filed: Nov. 29, 1993

[30] Foreign Application Priority Data

Jun. 25, 1993 [AU] Australia ..... PL9618

[51] Int. Cl.[6] ..... A63B 21/005

[52] U.S. Cl. ..... 482/6; 482/7; 482/900; 482/901; 482/902; 128/707

[58] Field of Search ..... 482/1–9, 51–54, 482/900–903; 601/23, 24, 26, 33–35; 128/695 R, 696, 700, 707

[56] References Cited

U.S. PATENT DOCUMENTS 4,436,097 3/1984 Cunningham ..... 482/900 X 4,848,737 7/1989 Ehrenfield ..... 482/900 X 5,318,487 6/1994 Golen et al. ..... 482/5

*Primary Examiner*—Richard J. Apley

*Assistant Examiner*—Glenn E. Richman

[57] ABSTRACT

A fitness device (22, 37, 41) is provided with a display type readout which can be viewed by a user, and a user's heart rate is determined to lie within a range so that the user could be required to work the equipment within that range. That range may vary with age of the user, and the "mode" of training which is itself determined by the user's general fitness. The device (22, 37, 41) comprises a movement resistance device (25), a digital encoder (28) attached to the device which provides digital pulses, and a microprocessor (30) which is programmed to readout (14) an output as a "distance" which is proportional to the number of pulses over the time taken to travel a "distance" which is preset into the machine.

11 Claims, 7 Drawing Sheets

FITNESS QUANTIFICATION EXERCISER

This invention relates to an exercise device which is arranged to accurately quantify the fitness of a user, or the performance of a user when the device is employed for rehabilitation purposes. It also relates to a method of quantifying fitness and/or performance.

BACKGROUND OF THE INVENTION

The closest prior art known to the Applicant exists in a rowing device of the type which utilises a paddle which is caused to move in a circular motion within a tank, and a computer is employed to display the stopwatch function of an exercise, a proportional distance in kilometres, speed in meters per second and strokes per minute. Such a device has been manufactured and sold by Water Power, Inc. 255 Armistice Blvd., Pawtucket, R.I. 02860. However, there are some other variables which need to be taken into account to assess performance with the degree of accuracy which is achieved by the invention described hereunder.

For example, there is a complex relationship between the speed at which a paddle moves in its tank and the resistance to the movement which needs compensation by a user's effort. The device needs to have mechanical adjustments made before it would be useful on general purpose machines such as squat machines, bench presses, steppers and the like. The physical size of the device would make it quite unsuitable for such devices.

Other prior art ,which may be regarded as relevant is in an exercise bike type of device wherein the energy expended by a user is absorbed by a dynamometer, and the dynamometer is interfaced with a heart rate monitor and a microprocessor, and reduces the load resistance if the heart rate exceeds the maximum rate within the range within which the user is intended to operate. Such a device is manufactured by REPCO Cylce Company, Huntingdale, Victoria, Australia. The dynamometer and heart rate monitor are both accurate devices which read out wattage generated by a user and heart rate, but additional invention appears to be required to cause the device to be useful for quantification of other than cardid vascular fitness levels. Furthermore, the device is essentially limited to a continuous motion which is effective in driving a dynamometer, and would be quite unsuitable for devices again such as squat machines, upright rowers, steppers, various upper body exercises such as bench presses and the like, wherein the energy is imparted to the device in a discontinuous manner.

The main object of this invention is to provide a simple device which will determine a user's fitness or performance within a range of accuracy which, as far as is known to the applicant, has not heretofore been achieved.

BRIEF SUMMARY OF THE INVENTION

In this invention, a fitness device is provided with a display type readout which can be viewed by a user, and a user's heart rate is determined to lie within a range so that the user could be required to work the equipment within that range. That range may vary with age of the user, and the "mode" of training which is itself determined by the user's general fitness. The device comprises a movement resistance device, a digital encoder attached to the device which provides digital pulses, and a microprocessor which is programmed to readout an output as a "distance" which is proportional to the number of pulses over the time taken to travel a "distance" which is preset into the machine.

The variables within this invention are heart rate range, the resistance to movement imparted by a movement resistance device, for example, an hydraulic ram, the impulses transmitted by the digital encoder, and time. In use, a user maintains his effort within the heart rate range as indicated by input of a heart monitor, reducing his effort if he approaches the upper range limit and increasing his effort if he approaches the lower range limit. Adjustment of hydraulic pressure or other resistance is preset, and the movement of an actuator is sensed by the digital encoder. The encoder signals are fed into the microprocessor, the output of which will provide a proportional "distance" travelled in the time during which the equipment is being used in a single session, and thereby simple and easily understood parameters provide an accurate assessment. It may be commented that the hydraulic equipment which is employed has been certified to lie within a required range of accuracy, 0.2 grams per kilogram. A typical heart range may be between 130 and 150 heart beats per minute, the maximum heart rate being estimated for people aged between 20 and 65 years as 220 less the age. Thus, for example, a maximum heart rate for a sixty year old person is 160. It is of course necessary that the heart rate should not approach 100% except for top level of training. Although the heart rate ranges may appear quite wide, heart beat rates vary widely with small variations of effort, and notwithstanding an apparently wide heart rate range, the equipment is nevertheless quite sensitive.

DESCRIPTION OF THE PREFERRED EMBODIMENT

An embodiment of the invention is described hereunder in some detail with reference to, and is illustrated in, the accompanying drawings, in which.

DETAILED DESCRIPTION OF THE PREFERRED EMBODIMENT

In FIGS. 1, 2, 3 and 4, three different types of exercise machines are illustrated. FIG. 5 is a simplified block diagram of the circuit shown in more detail in FIG. 6, but because of space limitations it has been necessary to separately show the details of the liquid crystal display and keyboard in FIG. 7. For the sake of conformity, the encircled numerals 11 through to 20 shown in FIGS. 5, 6 and 7 identify respectively the sub-assemblies of the circuit of FIGS. 6 and 7 as follows:

11—shaft encoder interface;

12—signal squarer for interfacing the heart monitor receiver with the central processing unit;

13—central processing unit;

14—liquid crystal display;

15—keyboard;

16—shaft encoder power switch;

17—heart monitor power switch;

18—audible alert beeper;

19—power plug pack for delivering 12 volts DC; and

20—a common regulator and power switching circuit.

Figure 5:
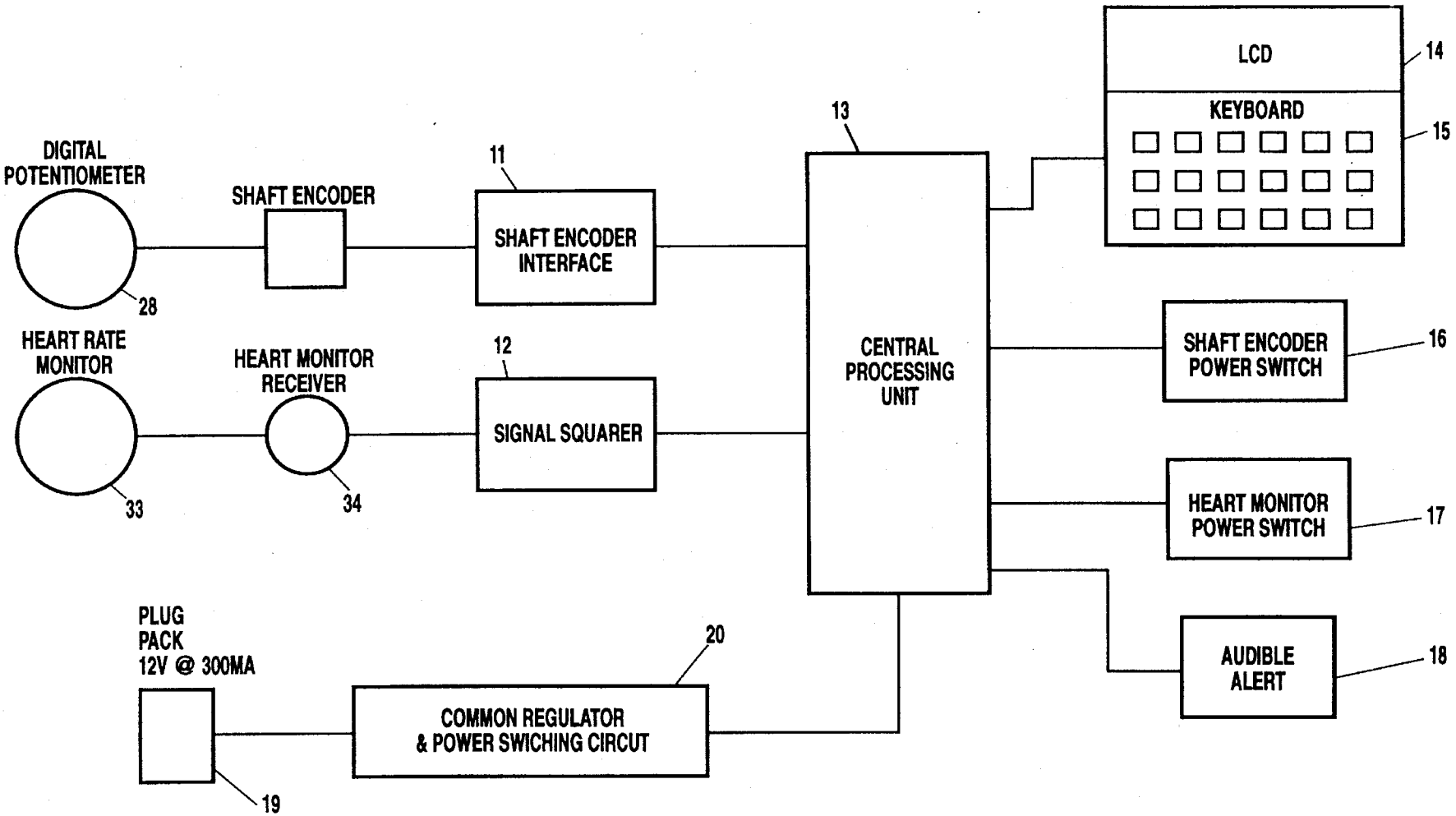
FIG. 5 is a simplified block diagram of the sub-assemblies of a circuit diagram.
Figure 6:
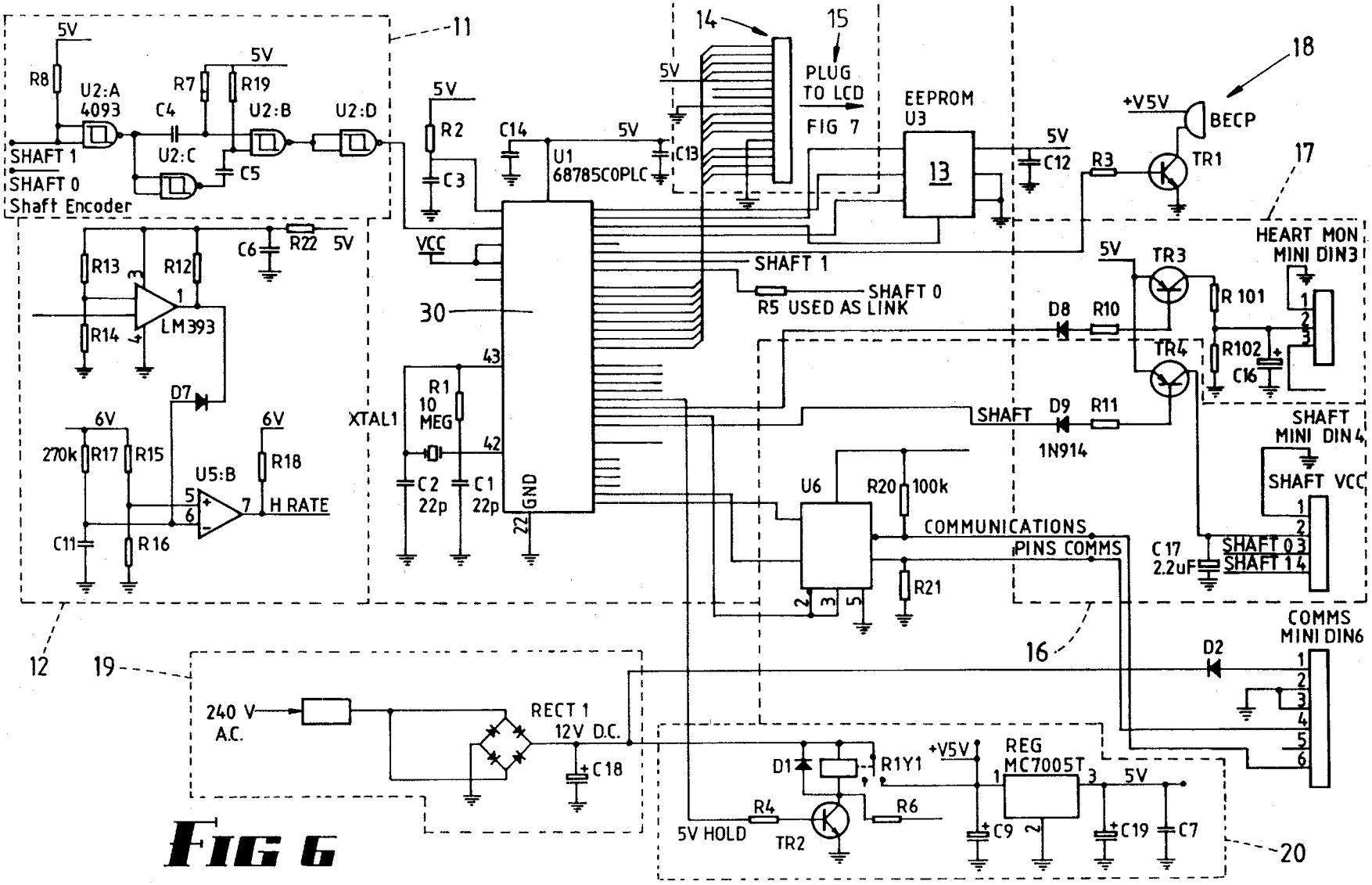
FIG. 6 is a circuit diagram, however not including details of the liquid crystal display.
Figure 7:
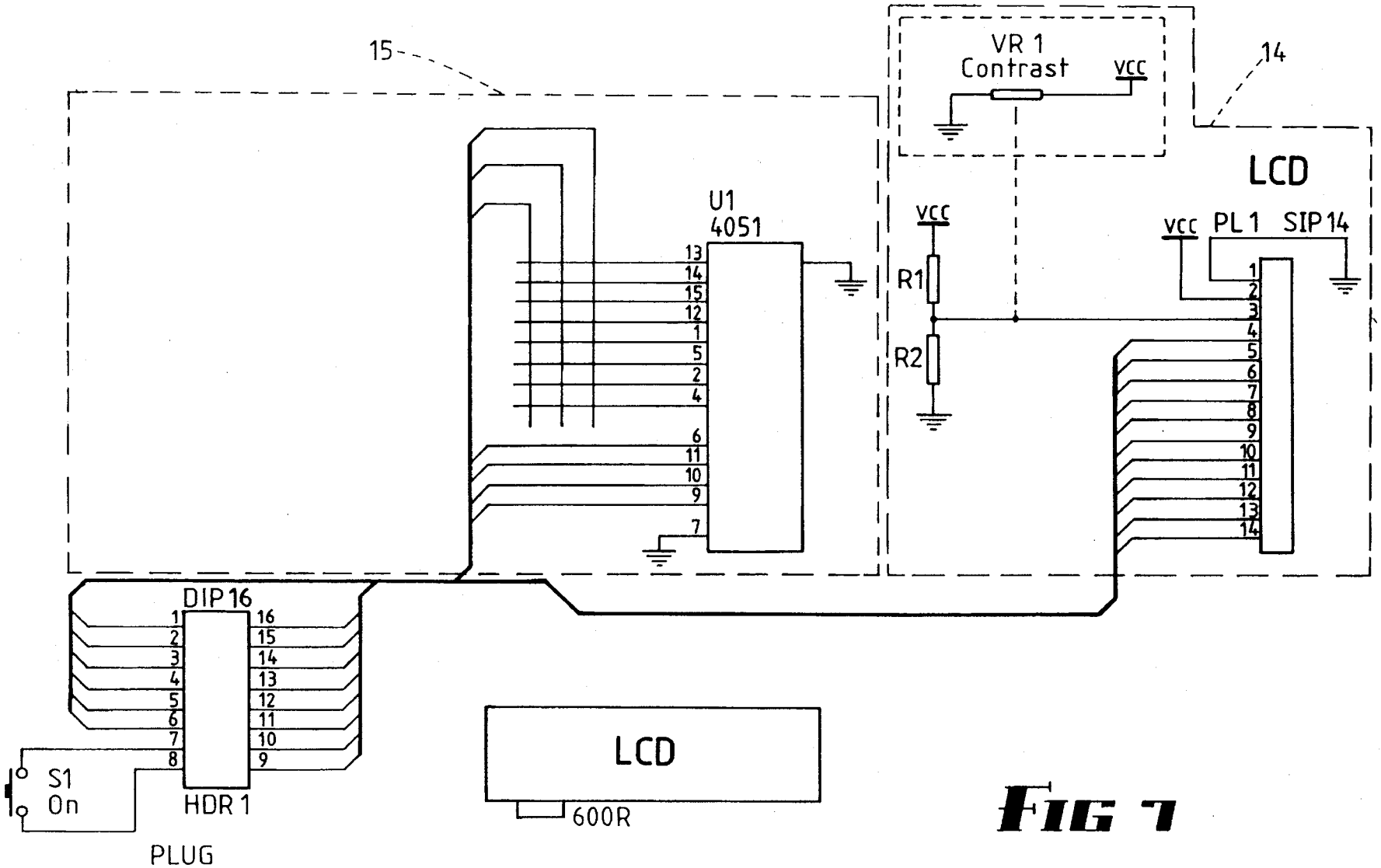
FIG. 7 is a circuit diagram of the liquid crystal display, which, in use, is plugged into that part of the circuit shown in FIG. 6.
Figure 8:
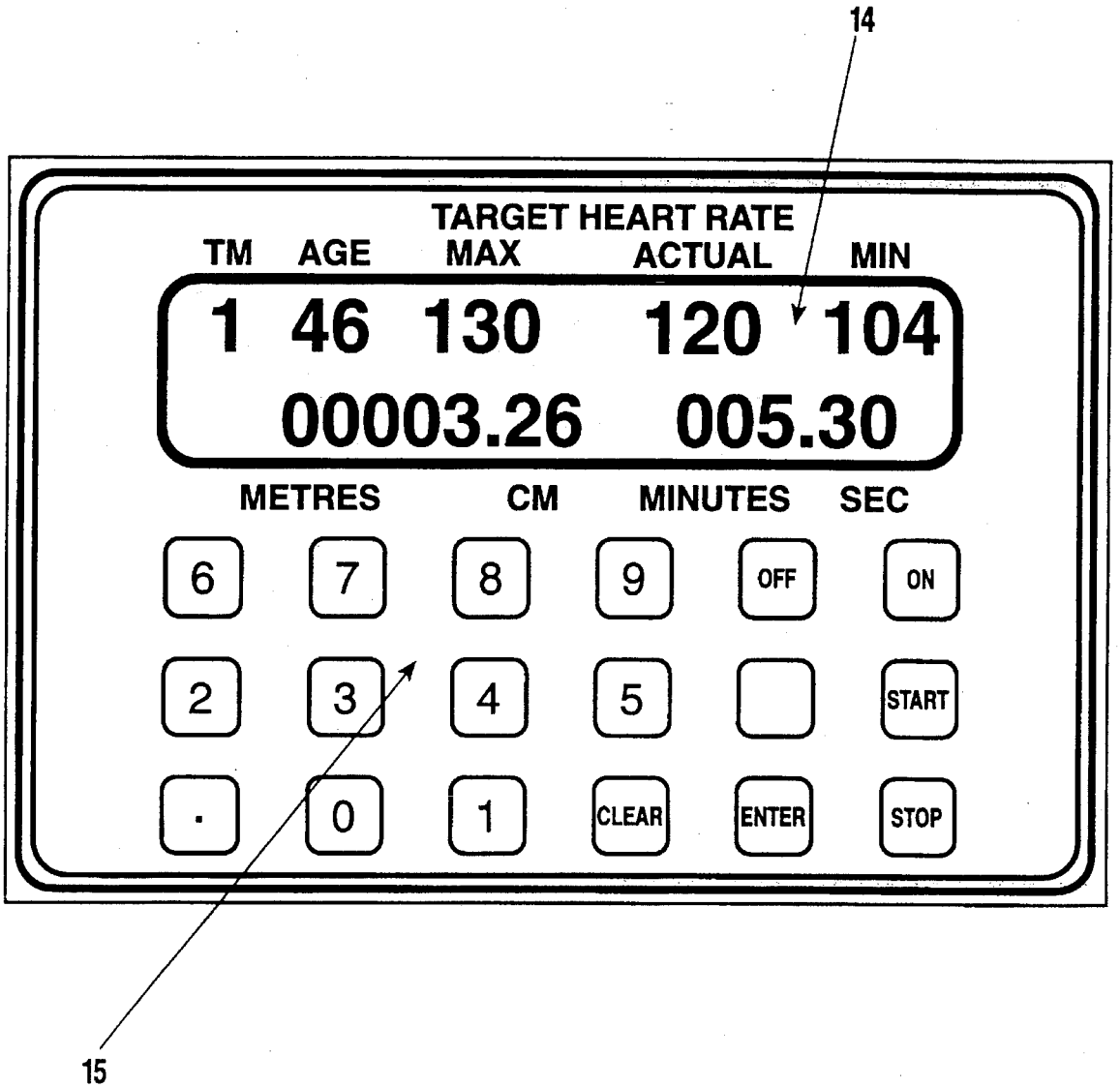
FIG. 8 is a front view of a keyboard and liquid crystal display console.

These are primarily identified on FIG. 5 and their positions in the general circuit of diagrams of FIGS. 6 and 7 are respectively identified in the same way as in FIG. 5.

Figure 1:
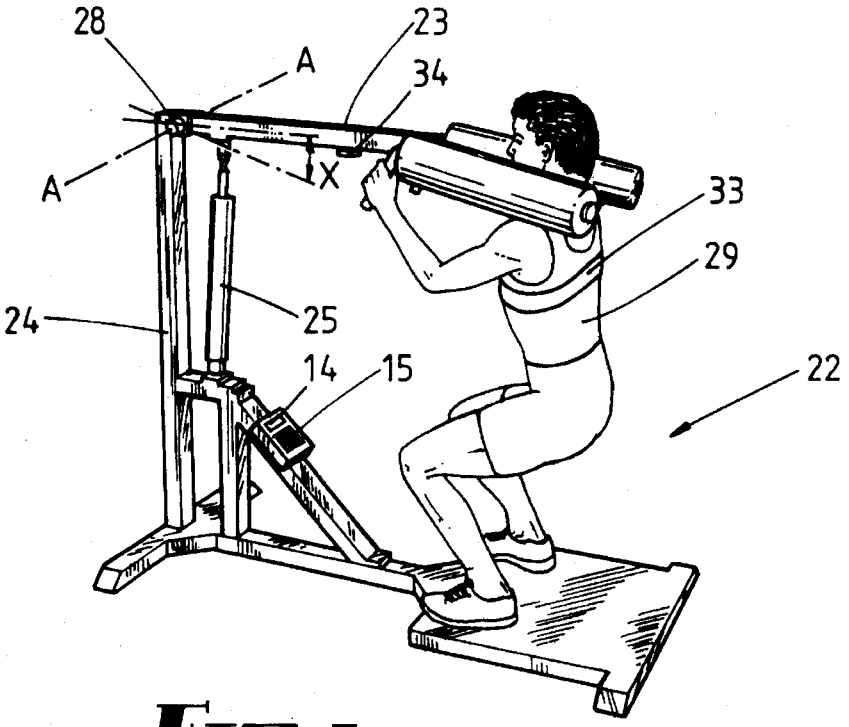
FIG. 1 is a perspective view which illustrates a user on a squat machine which is equipped with this invention.
Figure 2:
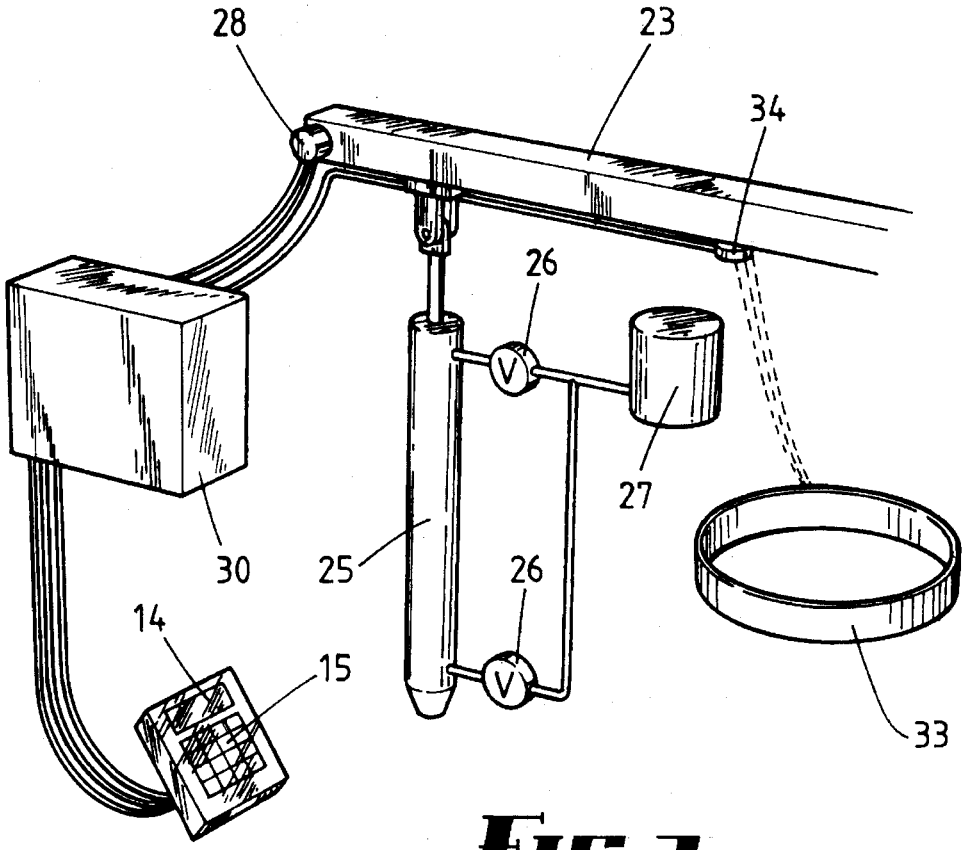
FIG. 2 is a diagrammatic representation of interconnection of the components of the invention on the machine of FIG. 1.

Referring firsfly to FIG. 1, a squat machine 22 has an arm 23 which is pivoted about an axis A—A to a frame 24 and is coupled to an hydraulic piston/cylinder assembly 25 so that upwards and downwards movement of the arm 23 will displace fluid between the upper and lower parts of the cylinder of assembly 25 and through a pressure actuated relief valve 26 (FIG. 2), the fluid being displaced into a reservoir 27.

A digital potentiometer 28 (Hewlett Packard HCDS-7500) functions as a shaft encoder which is carried by the frame 24 and is actuated by the pivotal movement of the arm 23 to generate pulses which identify the degree of movement X, both upwards and downwards, and which correspond in number with the distance travelled by a user 29. As explained below, the movement is also measured through the generation of pulses by the shaft encoder 28.

The pulses are fed into a micro-processor 30 which forms the heart of the central processing unit 13. Although the other micro-processors can be substituted, the micro-processor 30 in this circuit is a Motorola 68705C8PLC, and is referred to below in more detail. The micro-processor 30 is coupled to the encoder output, and is programmed to be responsive to fitness related parameters which include a numerical proportion of the number of pulses generated by the shaft encoder 28. Desirably the proportion of pulse numbers is measured in terms of "distance travelled" to be readily identifiable by a user not skilled in the art of identifying pulse numbers. The "distance travelled" can, for example, be in metres or yards. The proportion and the units are of course arbitrary.

The user 29 also wears a heart monitor belt 33 which embodies a small radio transmitter, the radio transmitter providing an RF link to the heart monitor receiver 34, the details of the receiver circuit being shown in FIG. 6. The transmitter however, is readily available under the trade mark "Polar", and manufactured by Polar Electro OY, Prusossorinrie 5,90440 Kempele, Finland.

The shaft encoder interface 11 transmits the encoded signals to the central processing unit 13 and the signal squarer 12 interfaces the heart rate identified by receiver 34, and those signals are delivered to the microprocessor 30 by the circuit shown in FIG. 6. The micro-processor then controls the read-out of heart rate as an identifiable signal in the liquid crystal display panel 14. The electronic sequence is described below. The liquid crystal display 14 is closely connected to keyboard 15 also as described below, it will be noticed that the position of the LCD and keyboard panels 14 and 15 on the machine 22 is such that it can be easily read by the user 29. At all times therefore the user will be aware of his heart rate. The significance of this is also described below.

Figure 3:
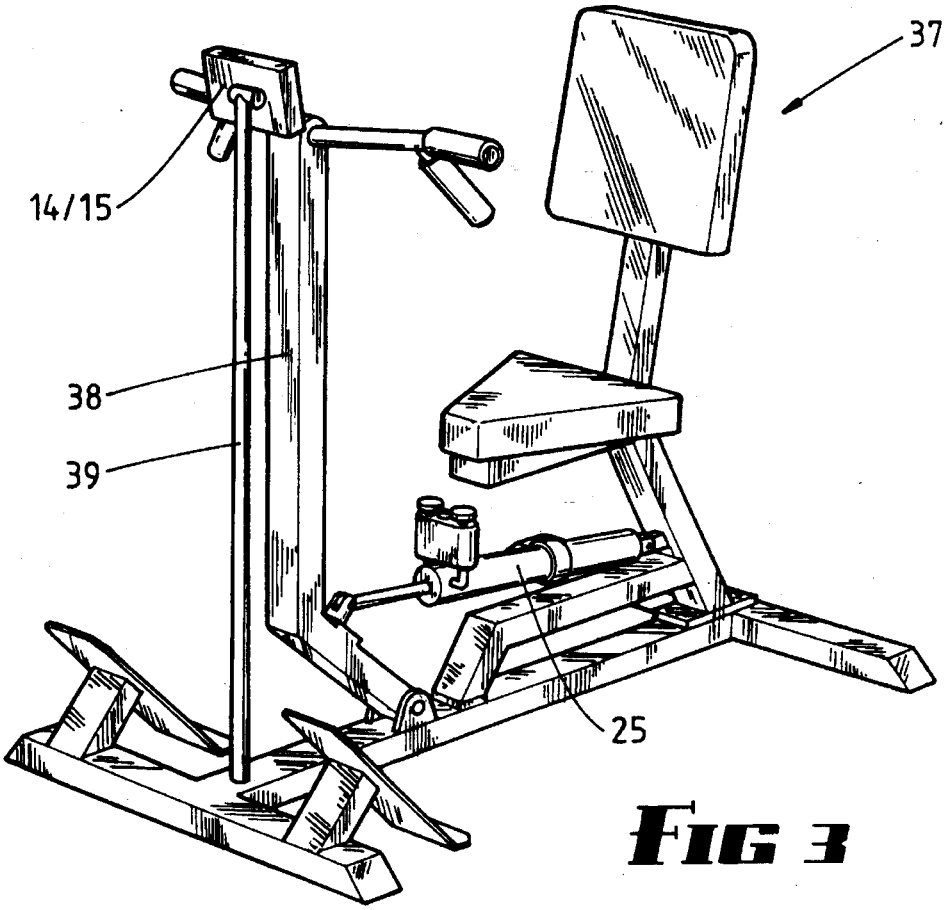
FIG. 3 is a perspective view of a vertical chest exercise machine, equipped with this invention.

FIG. 3 illustrates a vertical chest exercise machine 37 which has an arm 38 which can be oscillated in a manner similar to the oscillation of the arm 23 in FIG. 1, and the LCD/keyboard console 14/15 is again located at a position where it is easily read by a user, being on the top of a stanchion 39.

Figure 4:
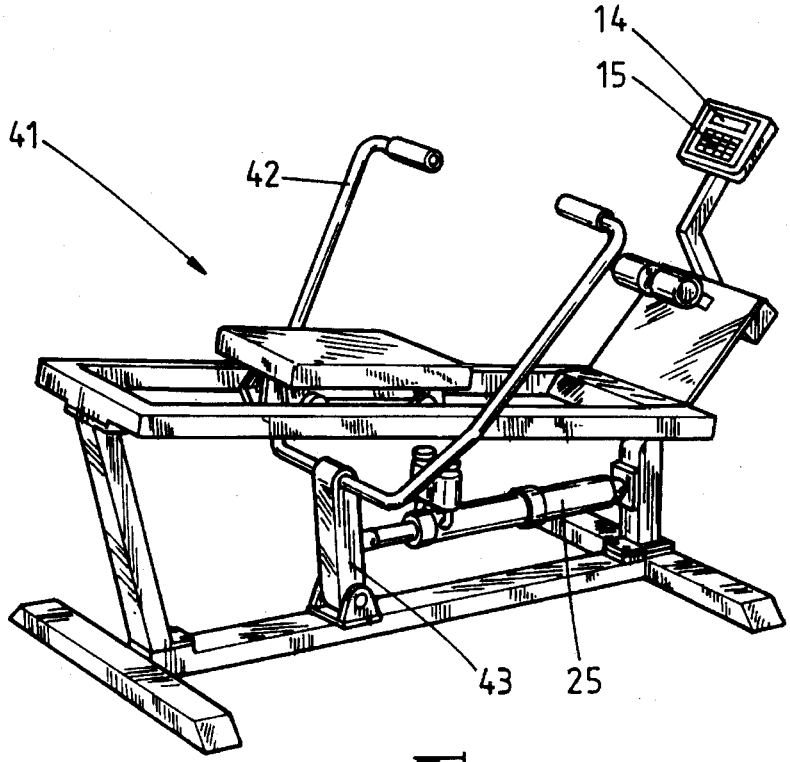
FIG. 4 is a perspective view of a Rower, equipped with this invention.

FIG. 4 illustrates a rowing machine 41 wherein an hydraulic cylinder 25 functions as in the first two embodiments by movement of the handles 42 which causes an oscillatory movement of the arm 43 and the results can be read out by the LCD/keyboard console 14/15 as in the first and second embodiments. These Figs provide examples of how the invention can be applied to different types of machines.

GENERAL FUNCTIONS OF THE ELECTRONIC CIRCUIT AND SOFTWARE

The primary requirement of this invention is to provide a ready means for a user to check his performance and compare it with previous performances. The hydraulic valve 26 can be adjusted, but is usually pre-set for use with this invention, since for most exercises one setting will cover the full range of variations between a fit person and an unfit person. There is a relationship between fitness (usually divided into five levels), age and useful range. The maximum heart rate recommended for a user can be calculated as 220 less the age, so that for example a person aged 60 should not exercise with a heart rate beyond 160, even if he is very fit. That heart rate range needs to be reduced as the perceived fitness of the user diminishes, as said, into one of five modes. These are identified as mode 1, mode 2, mode 3, mode 4 and mode 5. However, the effectiveness of exercising with the aid of this invention can be diminished if the heart rate is too low, and therefore there is a precalculated range of heart rates between minimum and maximum within which a user must control his exercise. The minimum figure is arbitrarily determined, but within a range generally accepted by health authorities. Therefore the possibility of a user exercising outside of this range must be readily identifiable, and the microprocessor will produce an identifiable signal if the heart-rate is below the minimum or above the maximum. In this specific embodiment the identifiable signal is simply a freezing of the read out on the liquid crystal display 14. A user will know whether it is necessary to increase or reduce his input to get his heart beat back into the desired range. With the circuit and software shown, all parameters freeze, including time and input during the time that a user is outside of the previously identified heart beat range.

DESCRIPTION OF THE ELECTRONIC CIRCUIT AND SOFTWARE

When a user is about to commence an exercise, after turning the machihe on, the LCD transmits a message "ENTER MODE". The user then sets the mode 1, 2, 3 or 4, (or 5 for more specific parameters which may be adjusted to suit an individual's requirements) and presses an ENTER button. The next message on the LCD 14 is asking the age of the user, that is entered and again the ENTER button is depressed. The next message on the LCD will be to identify the training time and if, for example, it is ten minutes the user presses "10" and then enters that again by depressing the ENTER button. The next message on the screen is to press the START button and when that is pressed, the screen will show on the top line the training mode, age, heart rate range (which it will calculate on the abovementioned formula) and as the exercise commences the actual heart rate of the user. The timer in the microprocessor will then "stopwatch" by counting down from 10 to 0 whilst within the selected heart rate range. The number of impulses will record the "distance" which is a proportion thereof. If the user moves out of this range, the LCD will freeze, as mentioned above, or optionally will cause the audio beeper alarm to sound.

The function of the electronic circuit is as follows:

Pulses from the heart monitor 33 are transmitted to the receiver 34, processed by the signal squarer 12, and enter the micro-processor in the central processing unit 13. Similarly the pulses from the digital potentiometer of the shaft encoder 28 are interfaced in the shaft encoder interface 11 and also fed into the central processing unit 13. This occurs while the timer is counting down.

The keyboard 15 is scanned at a regular rate (including during the run time) and the information is computed and displayed on the LCD 14. The microprocessor will control an audible alert beep each time a button is pressed, and the central processing unit 13 will provide a number of options, being START, STOP, OFF, CLEAR and the entering of the numbers by ENTER. All the required and computed information is displayed on the LCD 14. During the entry of data and at the appropriate time, power from the shaft encoder power switch 16 is applied to the shaft encoder allowing the signals to be processed by the central processing unit. Again at the appropriate time, power is applied via the heart monitor power switch 17 allowing the correct calculations to be made by the processor. Displaying and keyboard scanning will continue in this manner until the unit is turned off. The power is supplied in the form of an unregulated DC to the common regulator and power switch circuit 20, to turn the unit on or off.

Figure 9:
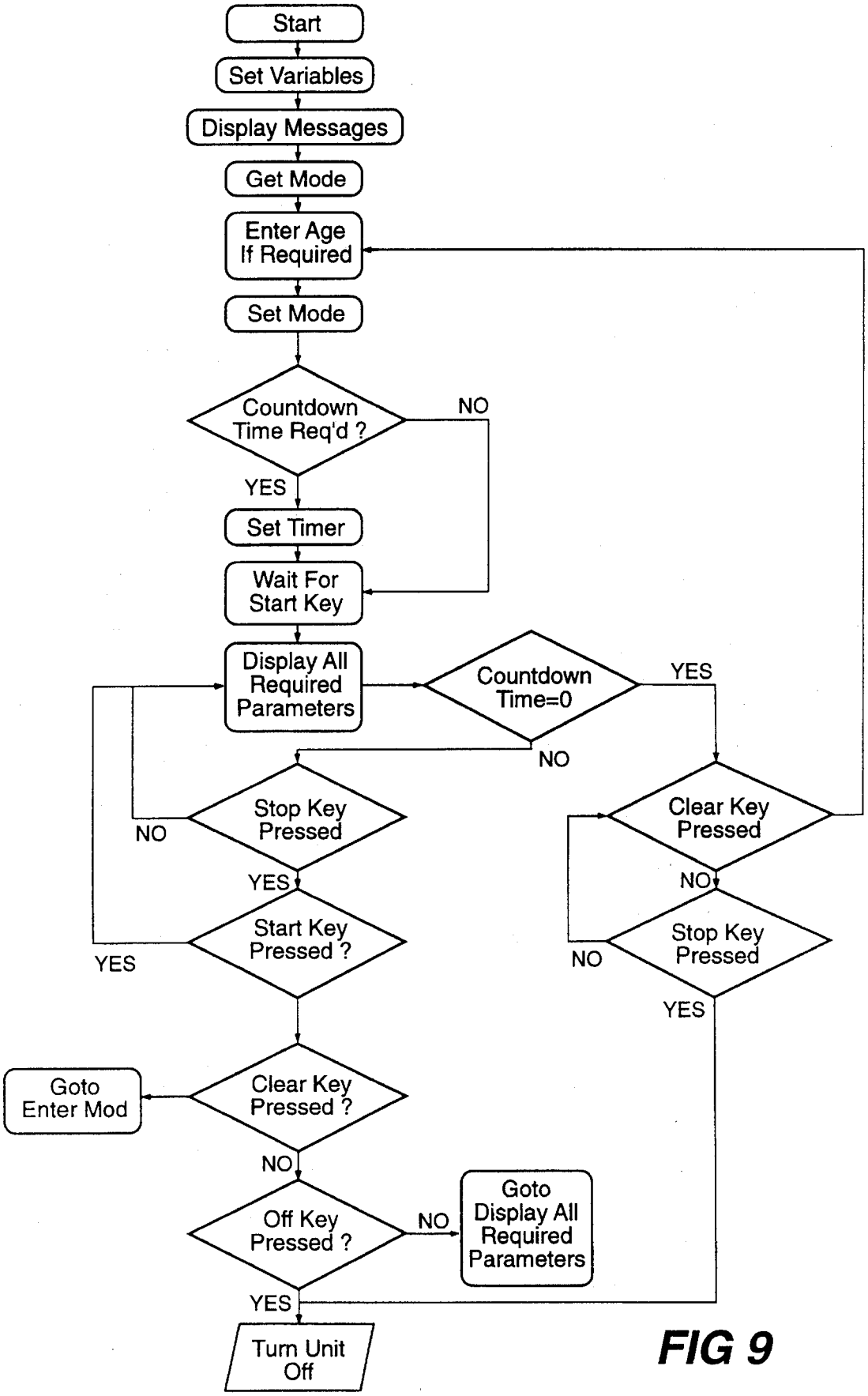
FIG. 9 is a graphical representation of the software algorithm.

FIG. 9 illustrates the software algorithm. A verbal description of FIG. 9 is as follows:

Firstly, the start switch is operated to bring power to the equipment. The software clears all variable memory space and sets the various memories to a default condition. It displays messages, a copyright message and the wording "FT100 Plus V1.0".

The next request is to request the user to enter the mode (1 to 5).

Upon entering the mode, and depending on the selected mode, the request is then made to enter age. After the age has been entered, the time of the exercise is also entered.

If no time is given, that is if the user elects to exercise for a variable time, or to make "distance" his parameter, the unit times up and not down.

After the time has been entered, a calculation is made by the microprocessor on the formula of 220 less the age to give a percentage of minimum and maximum heart rates in the selected mode, and that is displayed on the LCD 14.

The heart monitor and shaft encoder are then turned ON.

Exercise is commenced and as soon as the heart rate reaches the minimum, recordal of distance and time commence. If the heart rate moves out of the range, the unit waits until the heart rate corrects through more or less effort on the part of the user, and resumes automatically.

If the time expires, or if it is brought to a conclusion by pressing the STOP button, the LCD freezes its display, and allows the machine to be reset and restarted.

If the exercise was in the time mode (count down) at the end of the period, the audio beeper 18 signals completion. The system then waits for reset.

Consideration of the above embodiment will indicate that the invention provides a means and method which is very easily used by a user, it avoids the danger of over exercising, and it provides a surprisingly accurate comparison for a user against his own or other people's previous exercises, using primarily the heart rate range as the basic parameter of exercise.

I claim:

1. A fitness quantification device for an exercise machine having a stationary frame, an actuator movably coupled to said frame, and a resistance member coupled to said frame and said resistance member to provide resistance to movement of said actuator with respect to said frame, the fitness quantification device comprising:

a) a digital encoder coupled to said actuator and generating an output of electrical pulses corresponding to relative movement between said actuator and said frame;

b) a heart rate monitor worn by a user of the exercise machine during an exercise session, the monitor generating an output of electrical impulses corresponding to a current heart rate of the user, the monitor including a transmitter for transmitting impulses to a remote receiver; and c) a programmable microprocessor including input means coupled to said digital encoder for receiving electrical pulses generated by the encoder and coupled to said heart rate monitor receiver for receiving impulses generated by the heart rate monitor;

d) a selectively actuated timer coupled to said microprocessor; and e) a user interface means coupled to said microprocessor for input of data by the user and including a visual display for displaying a current value of said timer and a current value of an exercise parameter, said microprocessor being programmed:

i) to determine a minimum heart rate limit and a maximum heart rate limit for the user based on data input by the user; and ii) to actuate said timer during intervals of said session wherein said input means receives impulses from the heart rate monitor receiver corresponding to a user current heart rate within the minimum and maximum heart rate limits and to disable said timer during intervals when said input means receives impulses from the heart rate monitor receiver corresponding to a user current heart rate outside the minimum and maximum heart rate limits, the current value of the timer thereby providing a measure of elapsed time during which the user's heart rate is between the minimum and maximum heart rate limits; and iii) to count a number of electrical pulses generated by the digital encoder during the session and to determine the current value of the exercise parameter, the current value of the exercise parameter being a function of a count of the electrical pulses generated by the digital encoder.

2. The fitness quantification device set forth in claim 1 wherein said impulses from said heart rate monitor transmitter are transmitted to said heart rate monitor receiver via rf signals.

3. The fitness quantification device set forth in claim 1 further including alarm circuitry for generating an identifiable signal if said current heart rate is above the maximum heart rate limit.

4. A fitness quantification device according to claim 3 wherein the identifiable signal is generated if said current heart rate is below the minimum heart rate limit.

5. A fitness quantification device according to claim 1 wherein said read out comprises a liquid crystal display, and includes displays of minimum, actual and maximum heart rates, said numerical proportion of the number of impulses received by the micro-processor from the encoder, and time.

6. A fitness quantification device according to claim 1 wherein said exercise machine comprises a hydraulic piston/cylinder assembly, and coupling means coupling said actuator arm to said piSton/cylinder assembly to cause hydraulic fluid flow to occur upon relative movement of the piston within the cylinder, said resistance being a resistance against said fluid flow through a pressure control valve which is adjustable to vary said resistance.

7. A fitness quantification device according to claim 1, wherein said user interface means further comprises a keyboard for entry of data by the user and wherein the visual display comprises a liquid crystal display.

8. A fitness quantification device according to claim 1 wherein said device comprises a power supply means, a digital encoder switch and a heart monitor switch, and means for sequentially closing said switches to energize said monitor receiver and digital encoder to in turn enable said micro-processor to update said current value of the timer and said current value of the exercise parameter.

9. A method of quantifying the fitness of a user of an exercise machine, the steps of the method comprising:

a) providing a microprocessor to determine minimum and maximum heart rate limits based on physical characteristics of the user input to said microprocessor including the age and a relating measure of fitness of the user;

b) monitoring a current heart rate of the user during an exercise session;

c) providing a timer coupled to said microprocessor, said microprocessor actuating the timer during intervals of the session wherein the current heart rate of the user is within the minimum and maximum heart rate limits;

d) displaying a current value of the timer to the user during the session, the current value of the timer representing an elapsed time during the session where the user's heart rate is within the minimum and maximum heart rate limits; and e) repeating steps b) through d) at predetermined intervals of time.

10. The method of quantifying the fitness of a user of an exercise machine set forth in claim 9 wherein exercising on the exercise machine includes moving a component of the machine operatively connected to a digital encoder and the movement of the component causes the encoder to generate of electrical pulses, the method includes the additional steps of:

a) counting the electrical pulses generated by the encoder during the session;

b) determining a current value of an exercise parameter, said parameter a function of a number of electrical pulses counted during the session; and c) displaying the current value of the exercise parameter.

11. A fitness quantification device for an exercise machine having a frame, and wherein a user's exercise imparts pivotal consequential movement of an actuator arm of the machine against a resistance comprising:

a bearing in the frame, an actuator shaft journalled in said bearing for oscillatory movement, said shaft being fast with said actuator arm, a digital encoder coupled to said actuator shaft and having an output of electrical pulses which vary in number in accordance with amplitude of said actuator shaft oscillatory movement, a microprocessor coupled to said encoder output and programmed to be responsive to fitness related parameters, said parameters including a numerical proportion of said pulse numbers, and a time function capable of identifying the time elapse between commencement and termination of a sequence of said actuator movements, a heart rate monitor having a transmitter which when worn by a user transmits impulses in accordance with the user's heart rate, a receiver, and an electrical link between said transmitter and receiver, and means coupling said microprocessor to said receiver and arranged so that said microprocessor controls a read out of heart rate, and adjustment means which set at least a maximum heart rate, above which a function of said microprocessor controls production of an identifiable signal.

* * * * *